US006368446B1

(12) United States Patent
McNestry

(10) Patent No.: US 6,368,446 B1
(45) Date of Patent: Apr. 9, 2002

(54) LABEL APPLYING APPARATUS

(75) Inventor: Martin McNestry, Heanor (GB)

(73) Assignee: Markem Technologies Limited, Nottingham (GB)

( * ) Notice: Subject to any disclaimer, the term of this patent is extended or adjusted under 35 U.S.C. 154(b) by 0 days.

(21) Appl. No.: 09/165,168

(22) Filed: Oct. 1, 1998

(30) Foreign Application Priority Data

Oct. 8, 1997 (GB) ..... 9721248

(51) Int. Cl.[7] ..... B65C 9/14; B65C 9/28

(52) U.S. Cl. ..... 156/247; 156/249; 156/497; 156/542; 156/DIG. 31; 156/DIG. 38

(58) Field of Search ..... 156/541, 542, 156/497, DIG. 31, DIG. 38, 247, 249

(56) References Cited

U.S. PATENT DOCUMENTS

| | | | | | |
|---|---|---|---|---|---|
| 3,888,725 | A | * | 6/1975 | French | 156/556 |
| 4,392,913 | A | * | 7/1983 | Baumli | 156/584 |
| 4,526,648 | A | * | 7/1985 | Tochtermann | 156/497 |
| 4,556,443 | A | * | 12/1985 | Moya | 156/356 |
| 4,581,094 | A | * | 4/1986 | Sato | 156/352 |
| 4,612,076 | A | * | 9/1986 | Moss | 156/249 |
| 4,680,082 | A | * | 7/1987 | Kearney | 156/497 |
| 5,853,530 | A | * | 12/1998 | Allen | 156/541 |
| 5,885,406 | A | * | 3/1999 | Tiefel | 156/542 |
| 5,971,051 | A | * | 10/1999 | Crankshaw | 156/541 |
| 6,024,149 | A | * | 2/2000 | Bernhard et al. | 156/497 |

FOREIGN PATENT DOCUMENTS

| | | | | |
|---|---|---|---|---|
| DE | 19606199 C1 | 2/1996 | ..... | B65C/9/28 |
| GB | 1402179 A | 8/1975 | ..... | B65C/9/26 |
| GB | 2078668 A | 1/1982 | | |
| GB | 2291856 A | 2/1996 | ..... | B65C/9/28 |
| WO | WO9640560 A | 12/1996 | ..... | B65C/1/02 |

* cited by examiner

*Primary Examiner*—Richard Crispino
*Assistant Examiner*—Sue A. Purvis
(74) *Attorney, Agent, or Firm*—Fish & Richardson P.C.

(57) ABSTRACT

An apparatus for applying a label to an article comprising an applicator means having an applicator surface, means to establish a negative pressure at the applicator surface, a plurality of openings to the applicator surface, means to deliver pressurized gas to the openings or a selected set of the openings, and wherein the applicator means comprises a label receiving member spaced from the applicator surface and comprising a plurality of apertures, means to feed a label onto the label receiving member at which the label is maintained by the negative pressure established at the applicator surface, and when the pressurized gas is delivered to the openings in the applicator surface, the gas passes into the space between the applicator surface and the label receiving member, and through the apertures therein to propel the label towards the article.

17 Claims, 2 Drawing Sheets

LABEL APPLYING APPARATUS

BACKGROUND TO THE INVENTION

This invention relates to an apparatus for applying a label to an article and more particularly to such an apparatus of the so called blow applicator type in which a self adhesive label is applied to an article by means of pressurised gas which is usually supplied as a jet or blast.

DESCRIPTION OF THE PRIOR ART

Known such apparatus comprise an applicator surface comprising a plurality of, usually through, openings to at least selected ones of which pressurised gas may selectively be applied. The labels are conventionally stripped from a backing, fed onto the applicator surface and retained on the applicator surface, with the self adhesive surface facing away from the applicator surface, by establishing a negative pressure i.e. suction, which is applied through other openings e.g. slots in the surface, the effect of the suction being overcome when the pressurised gas is applied to the openings to propel the label.

One prior proposal is disclosed in GB-A-2078668 but in this proposal suction/pressurised gas is transmitted to an applicator surface from a vacuum/pressurised gas chamber, via pins, the positions of which can be varied to obtain optimum performance.

Known such apparatus operate reliably provided that the distance from the applicator surface to the article is within a small range, but as this distance is increased it is increasingly difficult to ensure that the labels are reliably applied. There is a requirement for such labels to be applied in generally consistent positions to each of a plurality of similar articles as well as for labels each to reach the articles in an appropriate orientation. Typically, the distance from applicator surface to article over which labels have reliably been applied, has not been more than 30 mm.

However there is a requirement for a label applicator apparatus which is able to propel labels reliably over greater distances.

SUMMARY OF THE INVENTION

According to a first aspect of the invention we provide an apparatus for applying a label to an article comprising an applicator means having an applicator surface, means to establish a negative pressure at the applicator surface, a plurality of openings to the applicator surface, means to deliver pressurised gas to the openings or a selected set of the openings, characterised in that the applicator means comprises a label receiving member spaced from the applicator surface and comprising a plurality of apertures, means to feed a label onto the label receiving member at which the label is maintained by the negative pressure established at the applicator surface and when the pressurised gas is delivered to the openings in the applicator surface, the gas passes into the space between the applicator surface and the label receiving member, and through the apertures therein to propel the label towards the article.

It has been found that an apparatus according to the invention is able more reliably to propel labels over greater distances than has hithertofore been attainable. In a prototype apparatus labels were reliable propelled over distance of at least 75 mm.

It is believed that by spacing a label receiving member away from the applicator surface, the force applied to the label by the pressurised gas is maximised.

Preferably the apertures in the label receiving member are of a size such that the flow of pressurised gas through the label receiving member is substantially unimpeded, and for examples only, the label receiving member may comprises a wire mesh or apertured plate. Also preferably, there is provided a side closure means to close the space between the applicator surface and the label receiving member.

This not only substantially prevents the flow of pressured gas from the space other than through the apertures of the label receiving member, but also, as with conventional apparatus, a label may be retained prior to application onto an article by suction, and the side closure means improves the suction effect. For example in the apparatus of the invention the applicator surface may comprise slots, and means may be provided to establish a negative pressure through the slots.

The suction achieved may thus be of sufficient strength to maintain a label on the label receiving member when fed onto the label receiving member, until the pressurised gas propels the label towards the article.

Typically the label applying apparatus includes means to print information on the labels just prior to the labels being applied to the articles.

According to a second aspect of the invention, we provide a method of applying a label to an article using an apparatus comprising an applicator means having an applicator surface, means to establish a negative pressure at the applicator surface, a plurality of openings to the applicator surface, means to deliver pressurised gas to the openings or a selected set of the openings, characterised in that the method comprises feeding the label onto a label receiving member which is spaced from the applicator surface, the label receiving member comprising a plurality of apertures, maintaining the label on the label receiving member by means of the negative pressure established at the applicator surface, delivering the pressurised gas to the openings in the applicator surface such that the gas passes into the space between the applicator surface and the label receiving member, and through the apertures therein to propel the label towards the article.

The method may include maintaining the label on the label receiving member until propelled onto the article by the pressurised gas, by applying suction through the applicator surface.

BRIEF DESCRIPTION OF THE DRAWINGS

The invention will now be described with reference to the accompanying drawings in which.

DESCRIPTION OF THE PREFERRED EMBODIMENTS

Figure 1:
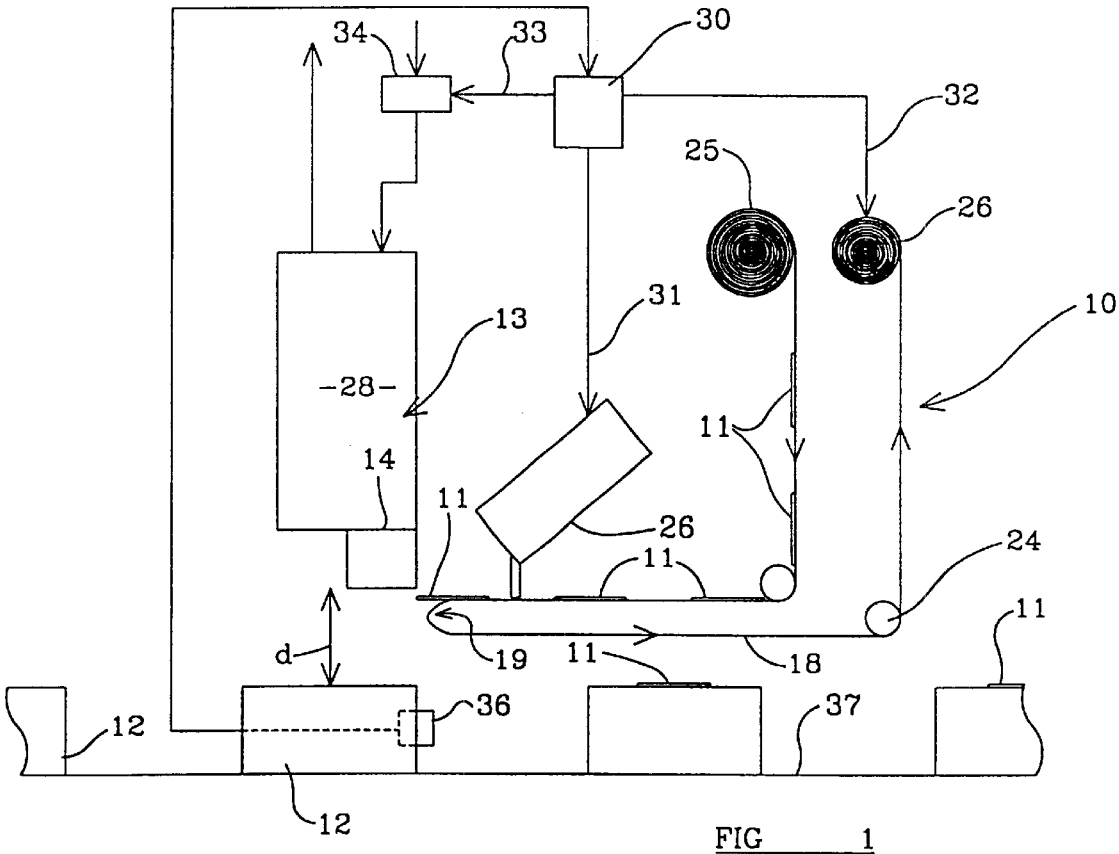
FIG. 1 is a diagrammatic illustration of an apparatus for applying a label according to the invention.

Referring to the drawing there is shown an apparatus 10 for applying labels 11 to articles 12, the apparatus 10 comprising an applicator means 13 having an applicator surface 14 afforded by a plate like member, the member having a plurality of openings 15*a*, 15*b*, 15*c* etc. therethrough to the applicator surface 14, there being blow pipes 16*a*, 16*b*, 16*c* etc. connected to selected ones of the openings 15*a*, 15*b*, 15*c* etc. through which a blast of pressurised gas can be delivered to the openings to propel a label 11 away from the applicator surface 14 towards the article 12.

In accordance with the invention, the applicator means 13 comprises a label receiving member 20 onto which labels 11 may be fed severally from backing sheet 18, as they peeled from the backing sheet 18 by a beak element 19 as is well known in the art. The label receiving member 20 is spaced from the applicator surface 14 and thus a space S is provided into which the blast of air is delivered from the openings 15*a*, 15*b*, 15*c* etc. the air then passing through apertures 21 in the label receiving member 20 to act upon the label 11 and propel it away from the applicator surface 14.

The sides of space S are closed by side closure means 17.

Figure 3:
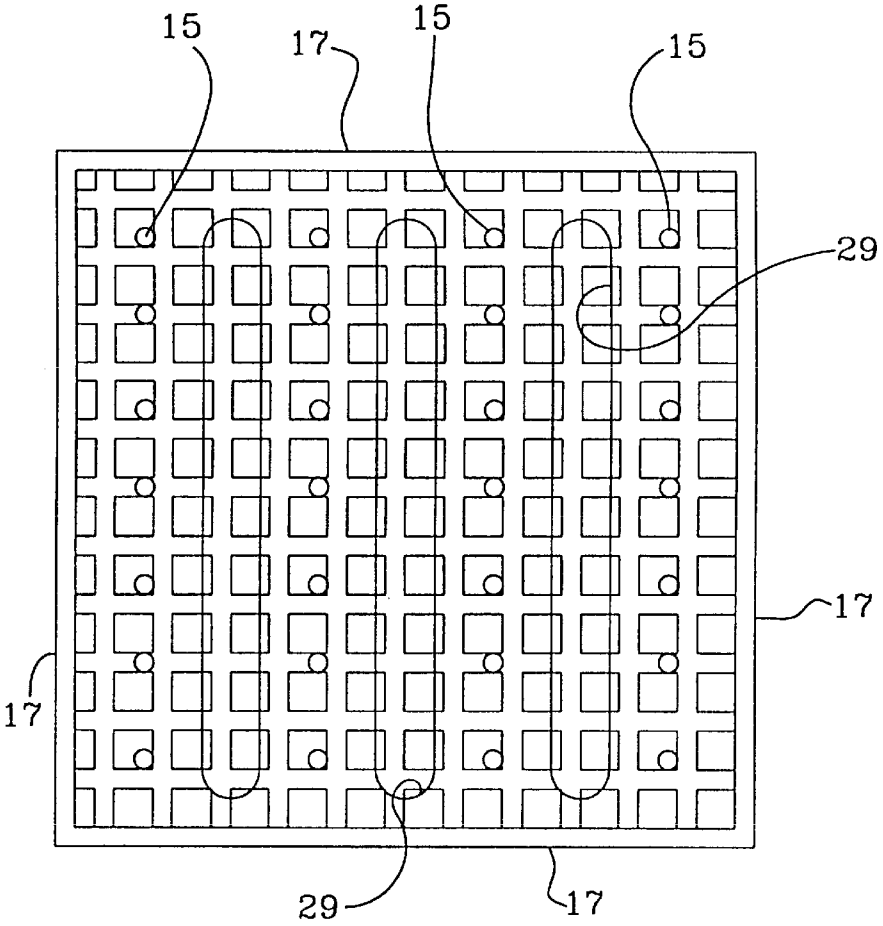
FIG. 3 is an underside plan view of the part of the apparatus shown in FIG. 2.
Figure 2:
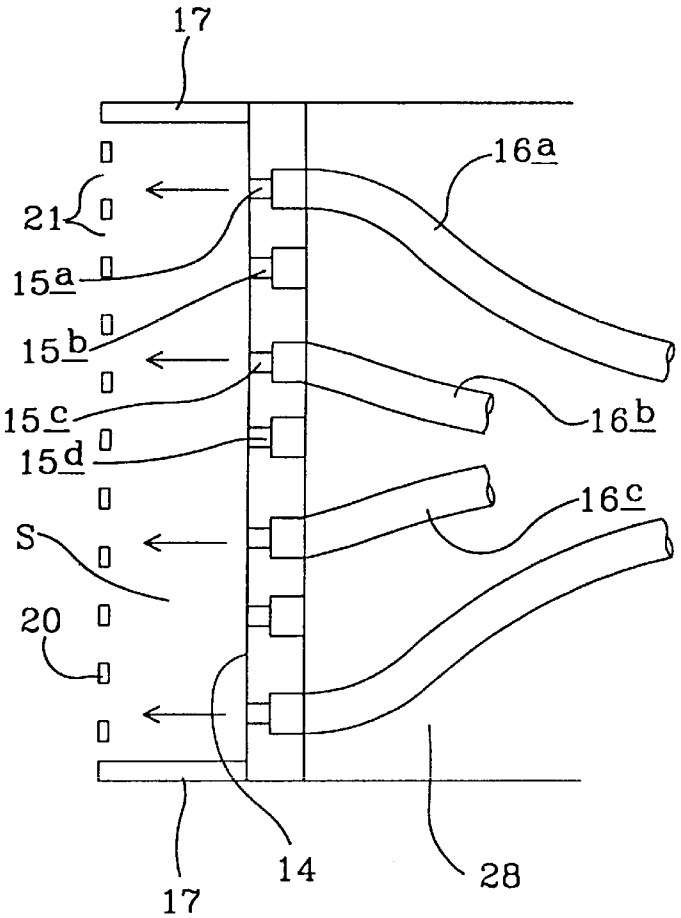
FIG. 2 is a detailed cross-sectional view through part of the apparatus of FIG. 1

It can be seen from FIG. 3 that the applicator surface 14 has a substantial number of through openings 15*a*, 15*b*, 15*c* etc. The blow pipes 16*a*, 16*b*, 16*c* etc. can be connected to any desired ones of the openings 15*a*, 15*b*, 15*c*etc. depending on the size and shape of labels 11 to be applied. The labels 11 are supplied on a backing sheet 18 from a label supply spool 25 and in this example, are printed with information utilising a thermal transfer printing head 26 immediately prior to their removal from the backing sheet 18 and then the application of the label 11 to an article 12.

In order to retain a label 11 on the label receiving member 20, a vacuum is induced within a space 28 within the applicator means 13 through which the blow pipes extend 16*a*, 16*b*, 16*c*etc. and slots 29 are provided in the applicator surface 14, so that suction is applied at the applicator surface 14. This suction may be discontinued when a blast of air is supplied to the openings 15*a*, 15*b*, 15*c* etc. to propel a label 11 towards the article 12, although in general the force supplied by the blast of air will be sufficient to overcome the weaker suction effect through the slots 29.

Preferably the apparatus 10 is controlled by a computer type control means 30 which provides an input 31 to the thermal transfer printing head 26, which thus prints requisite information on the labels 11, an input 32 to a motor (not shown) which is used to drive a take up spool 25 or drive roller 24, to convey the backing sheet 18 through the apparatus 10 from a supply spool 25 to the take-up spool 26. The control means 30 may also provide an input 33 to a pneumatic valve 34 which opens to permit a blast of pressurised air to be supplied to the openings 15*a*, 15*b*, 15*c* etc. through the blow pipe 16*a*, 16*b*, 16*c* etc. The control means 30 may receive an input from a sensor 36 positioned to sense the proximity of an article 12 to which a label is to be applied, as article 12 is conveyed along a conveyor 37 past the applicator means 13.

Operation of the apparatus 10 described will now be explained.

The articles 12 are conveyed in sequence along the conveyor 37. The articles 12 may be equally spaced or unequally spaced and the speed at which the articles 12 are conveyed my be constant or may vary.

A label 11 is printed by the thermal transfer print head 26 with requisite information. The print head 26 may traverse a stationary label 11, or a label 11 may be traversed past the print head 26 as desired, or both may relatively move. When a label 11 is printed, the control means 30 provides output 32 to index the backing sheet 18 such that the printed label 11 passes the beak 19 and is thus stripped from the backing sheet 18. The label 11 is thus fed onto the label receiving member 20 where suction is constantly being applied and is thus retained on the label receiving member 20.

When control means 30 receives the input from sensor 36 that an article 12 is in position beneath the applicator means 13, the control means 30 provides output 33 to open the pneumatic valve 34 and thus a blast of 15*a*, 15*b*, 15*c* etc. in the applicator surface 14 into the space S between the applicator surface 14 and the label receiving member 20. The air will cause the label to be propelled over distance d onto the article 12.

It has been found that by virtue of the provision of the apertured label receiving member 20, the distance d over which a label 11 may reliably be propelled and applied by a blast of pressurised air, to an article 12, can be significantly increased compared with known blow type applicator arrangements, for example at least to a distance of 75 mm or more.

The apparatus 10 described may be modified without departing from the scope of the invention. For example, the labels 11 may be printed by other than a thermal transfer print head, and may be stripped from their backing sheet 18 by other than a beak 19 arrangement.

As mentioned above, a vacuum need not continuously be provided to space 28 of the applicator means 13 but suction may only be applied when the pneumatic valve 34 is closed. The actual configuration of openings 15*a*, 15*b*, 15*c* etc. and slots 29 may be otherwise than indicated.

In the example described, a label receiving member 20 comprises a thin apertured metal plate or grill, but could comprise a wire mesh or similar arrangement. In each case, the label receiving member 20 provides no or substantially no obstruction to the flow of pressurized air from the space 25 between the member 20 and the applicator surface 14.

The features disclosed in the foregoing description, or the following claims, or the accompanying drawings, expressed in their specific forms or in terms of a means for performing the disclosed function, or a method or process or attaining the disclosed result, as appropriate, may separately or in any combination of such features, be utilised for relising the invention in diverse forms thereof.

What is claimed is:

1. A method of applying a label to an article using an apparatus comprising an applicator having an apertured applicator surface, the apparatus constructed to establish a negative pressure at the applicator surface through said apertured applicator surface, and to deliver pressurized gas through the apertured applicator surface, and wherein the method comprises feeding the label onto a label receiving member which is spaced from the applicator surface, the label receiving member comprising a plurality of apertures, maintaining the label on the label receiving member by the negative pressure established at the applicator surface, delivering the pressurized gas to the openings in the applicator surface, delivering the pressurized gas to the openings in the applicator surface such that the gas passes into the space between the applicator surface and the label receiving member, and through the apertures therein to propel the label towards the article.

2. The method of claim 1 wherein the label receiving member is a generally planar element defining an open plenum between the applicator surface and the member.

3. The method of claim 1 or 2 wherein the label is propelled a distance of 30 mm or more.

4. The method of claim 3 wherein the label is propelled about 75 mm or more.

5. The method of claim 3 wherein the receiving member comprises a wire mesh.

6. The method of claim 3 wherein the receiving member comprises an aperture plate.

7. An apparatus for applying a label to an article comprising an applicator having an apertured applicator surface, the apparatus constructed to establish a negative pressure at the applicator surface through said apertured applicator surface, and to deliver pressurized gas through the apertured applicator surface, and a label receiving member spaced from the applicator surface and comprising a plurality of apertures, such that a label fed onto the label receiving member is maintained by the negative pressure established at the applicator surface, and when the pressurized gas is delivered to the openings in the applicator surface, the gas passes into the space between the applicator surface and the label receiving member, and through the apertures therein to propel the label towards the article.

8. An apparatus according to claim 7, wherein the apertures in the label receiving member are of a size such that the flow of pressurised gas through the label receiving member is substantially unimpeded.

9. An apparatus according to claim 7 or 8 wherein the label receiving member comprises a wire mesh.

10. An apparatus according to claim 7 wherein there is provided a side closure to close space between the applicator surface and the label receiving member.

11. An apparatus according to claim 7 wherein the applicator surface comprises slots, and a negative pressure is established through the slots.

12. An apparatus according to claim 11 wherein a negative pressure through the slots is established by a suction device of sufficient strength to maintain a label on the label receiving a member when fed onto the label receiving member until the pressurized gas propels the label towards the article.

13. An apparatus according to claim 7 which comprises a printer that prints information on the labels just prior to the labels being applied to the articles.

14. The apparatus of claim 7 wherein the label receiving member is generally planar element defining an open plenum between the applicator surface and the member.

15. The apparatus of claim 7 further including an article handler to position the article at a distance, d, such that the label is propelled more than 30 mm.

16. The apparatus of claim 7 further including an article handler to position the article at a distance, d, such that the label is about 75 mm or more.

17. The apparatus of claim 1 wherein the receiving member is an apertured plate.

* * * * *